US005174669A

United States Patent [19]

Fushimi et al.

[11] Patent Number: 5,174,669

[45] Date of Patent: Dec. 29, 1992

[54] LABEL SEPARATING DEVICE IN LABEL PRINTER

[75] Inventors: Kazuhiro Fushimi; Takeshi Tashiro; Kazuaki Sugimoto, all of Shizuoka, Japan

[73] Assignee: Tokyo Electric Co., Ltd., Tokyo, Japan

[21] Appl. No.: 575,824

[22] Filed: Aug. 31, 1990

[30] Foreign Application Priority Data

Sep. 4, 1989 [JP] Japan ..... 1-228593

[51] Int. Cl.[5] ..... B41J 15/00

[52] U.S. Cl. ..... 400/617; 400/120; 101/288; 101/228; 156/DIG. 24

[58] Field of Search ..... 400/120, 611, 617, 613; 101/288, 228; 156/384, 584, DIG. 24; 226/152, 156

[56] References Cited

U.S. PATENT DOCUMENTS

| | | | |
|---|---|---|---|
| 3,926,110 | 12/1975 | Hubbard et al. | 101/288 |
| 4,264,396 | 4/1981 | Stewart | 156/361 |
| 4,652,317 | 3/1987 | Seestrom | 101/288 X |
| 4,685,815 | 8/1987 | Baranyi | 400/120 |
| 4,712,114 | 12/1987 | Kikuchi | 101/288 X |
| 4,769,103 | 9/1988 | Koike et al. | 101/288 |
| 5,040,461 | 8/1991 | Van-Ocker | 400/120 X |

FOREIGN PATENT DOCUMENTS

| | | |
|---|---|---|
| 0361693 | 4/1990 | European Pat. Off. . |
| 2816161 | 10/1979 | Fed. Rep. of Germany . |
| 3527632 | 2/1987 | Fed. Rep. of Germany . |
| 57-132550 | 2/1982 | Japan . |

*Primary Examiner*—Edgar S. Burr
*Assistant Examiner*—Christopher A. Bennett
*Attorney, Agent, or Firm*—Oblon, Spivak, McClelland, Maier & Neustadt

[57] ABSTRACT

According to the present invention, there is used a conveyance roller for the conveyance of a pasteboard with labels; a separating member is disposed on a downstream side from a pasteboard conveyance path with respect to a printing head which holds the pasteboard with labels between the same and a platen, and in a position close to the printing head; and a pinch roller is provided for holding between the same and the conveyance roller the pasteboard portion which has been bent and separated from a label after printing by the separating member. The conveyance of the pasteboard with labels for printing and the conveyance of the pasteboard for label separating can be done at a time by driving either the conveyance roller or the pinch roller.

8 Claims, 3 Drawing Sheets

LABEL SEPARATING DEVICE IN LABEL PRINTER

FIELD OF THE INVENTION AND RELATED ART STATEMENT

The present invention relates to a label printer for printing required matters on a label stuck on an elongated pasteboard and then separating the printed label from the pasteboard. Particularly, the present invention is concerned with a label separating device for separating a label from a pasteboard.

According to a known label printer, required matters are printed on each label stuck on a pasteboard and then the printed label is separated from the pasteboard. In a label printer of this type using an elongated pasteboard, means for conveying the pasteboard in printing and means for conveying the pasteboard to separate the printed label from the pasteboard are independently provided. An example of such a conventional device will be described below with reference to FIGS. 1 and 2.

A pasteboard 1 with labels, or an elongated pasteboard la with plural labels 1*b* stuck thereon is used. The pasteboard 1 with labels is sandwiched between a platen 2 and a thermal head 3 while being guided along a predetermined guide path. On a downstream side of a pasteboard conveyance path with respect to the platen 2 and the thermal head 3, there is provided a separating plate 4. Further, a separating roller 5 is provided under the platen 2 in the same axial direction, and a pinch roller 6 is held in pressure contact with the separating roller 5 so as to be movable away from the roller 5. Dedicated driving units (not shown) are connected to the platen 2 and the separating roller 5, respectively.

In the label printer of the above construction, the pasteboard 1*a* is drawn out in the conveyance path downstream from the separating plate 4 and is held between the separating roller 5 and the pinch roller 6. More specifically, the pinch roller 6 is moved away from the separating roller 5, and then the pasteboard la is inserted between both rollers, so that the pinch roller 6 is again brought into pressure contact with the separating roller 5. The platen 2 is turned in synchronism with line-by-line printing for each label lb by the thermal head 3, whereby the printing for the label 1*b* and the conveyance of the pasteboard 1 with labels are performed simultaneously. At this time, the separating roller 5 also rotates and pulls the pasteboard 1*a* without any sagging. Consequently, on the separating board 4, the pasteboard 1 with printed labels is bent at an acute angle, whereby the printed label 1*b* is separated from the pasteboard 1*a* and is issued from an issuance port (not shown).

The platen 2 as a means for conveying the pasteboard 1 with labels is constituted separately from the separating plate 4, separating roller 5 and pinch roller 6 as means for separating each printed label 1*b* from the pasteboard 1*a*. Consequently, the number of components is increased, the manufacture of the device is complicated, and a large space is required, thus resulting in increased size of the entire device. Further, since the separate driving units are used for the platen 2 and the separating roller 5, discrepancy is apt to occur between a conveyance speed for the pasteboard 1*a* by the platen 2 and that by the separating roller 5. Once there occurs such discrepancy, the normal separation of the label 1*b* on the separating plate 4 may become impossible, or the normal printing may become no longer feasible due to change in the conveyance speed for the pasteboard 1*a* by the platen 2.

OBJECTS AND SUMMARY OF THE INVENTION

It is the first object of the present invention to provide a label separating device in a label printer capable of decreasing the number of the whole components of the label printer.

It is the second object of the present invention to provide a label separating device in a label printer which permits easy manufacture of the label printer as a whole.

It is the third object of the present invention to provide a label separating device in a label printer which contributes to reduction in size of the label printer as a whole.

It is the fourth object of the present invention to provide a label separating device in a label printer capable of making the conveyance speed of a pasteboard with labels for printing and that of the pasteboard for label separation coincident with each other.

In order to achieve the above-mentioned objects, a label separating device according to the present invention comprises: a conveyance roller for conveying a pasteboard with labels guided along a predetermined path; a separating member disposed on a downstream side from the pasteboard conveyance path with respect to a printing head for holding the pasteboard with labels between the same and a platen, and in a position close to the printing head; and a pinch roller for holding, between the same and the conveyance roller, the pasteboard portion which has been bent and separated from the printed label by the separating member. With this construction, as the conveyance roller rotates, the pasteboard with labels moves between the platen and the printing head, while at the same time the pasteboard portion which has been separated from the printed label by the separating member and is now held between the conveyance roller and the pinch roller is also moved. Thus, the conveyance of the pasteboard with labels for printing and that of the pasteboard for label separation are performed simultaneously. Consequently, it is possible to decrease the number of the whole components of a label printer, facilitate the manufacture and reduce the size thereof. Further, the conveyance speed of the pasteboard for printing coincides with that of the pasteboard for label separation.

DESCRIPTION OF PREFERRED EMBODIMENTS

Figure 1:
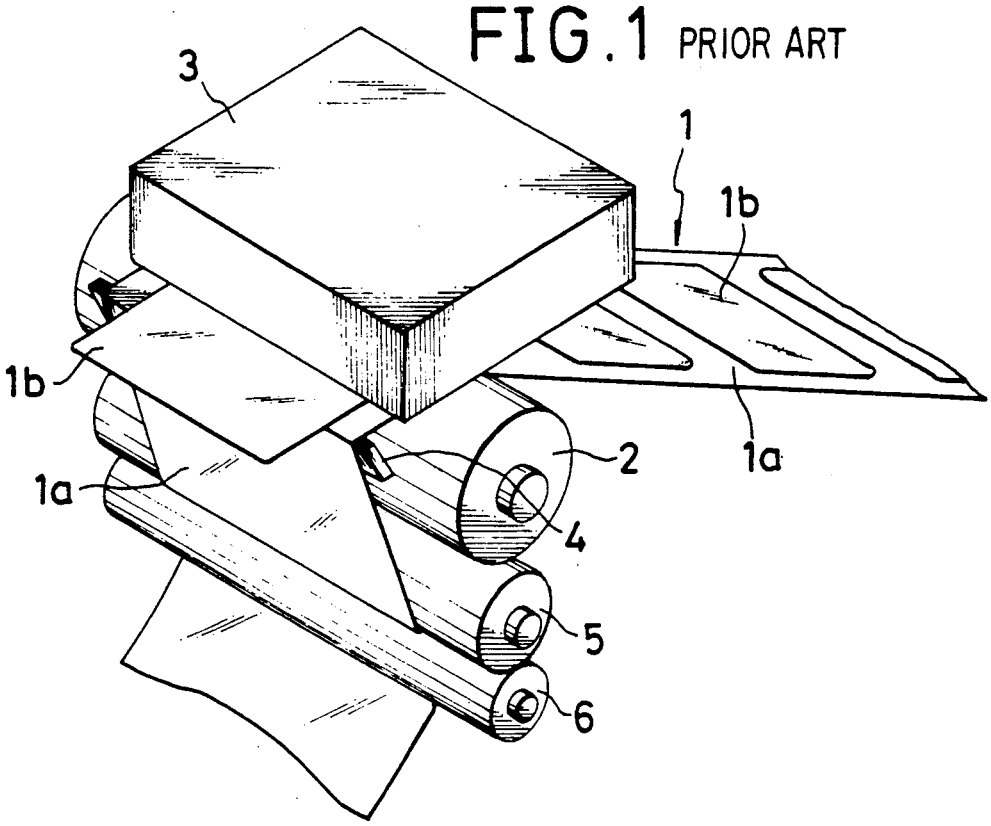
FIG. 1 PRIOR ART
FIG. 1 is an entire perspective view of a label separating device in a prior art example.
Figure 2:
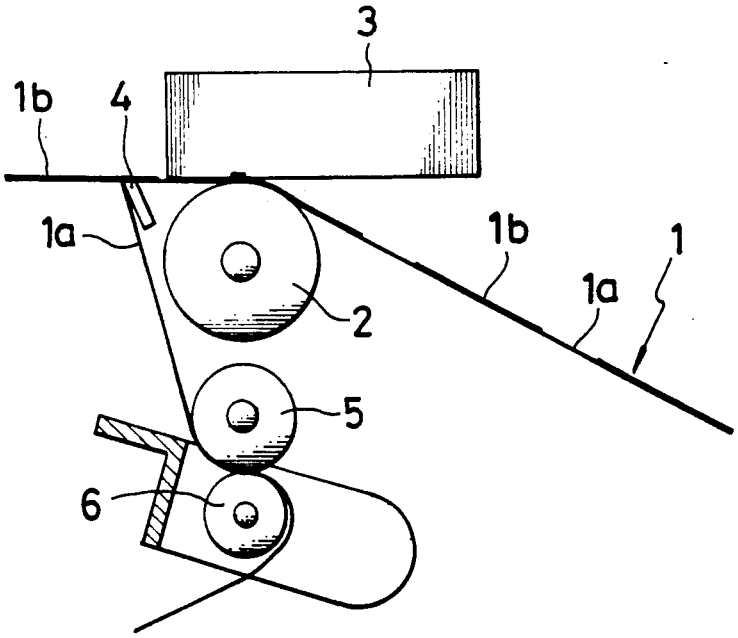
FIG. 2 PRIOR ART
FIG. 2 is a side view of a label separating device in a prior art example.
Figure 3:
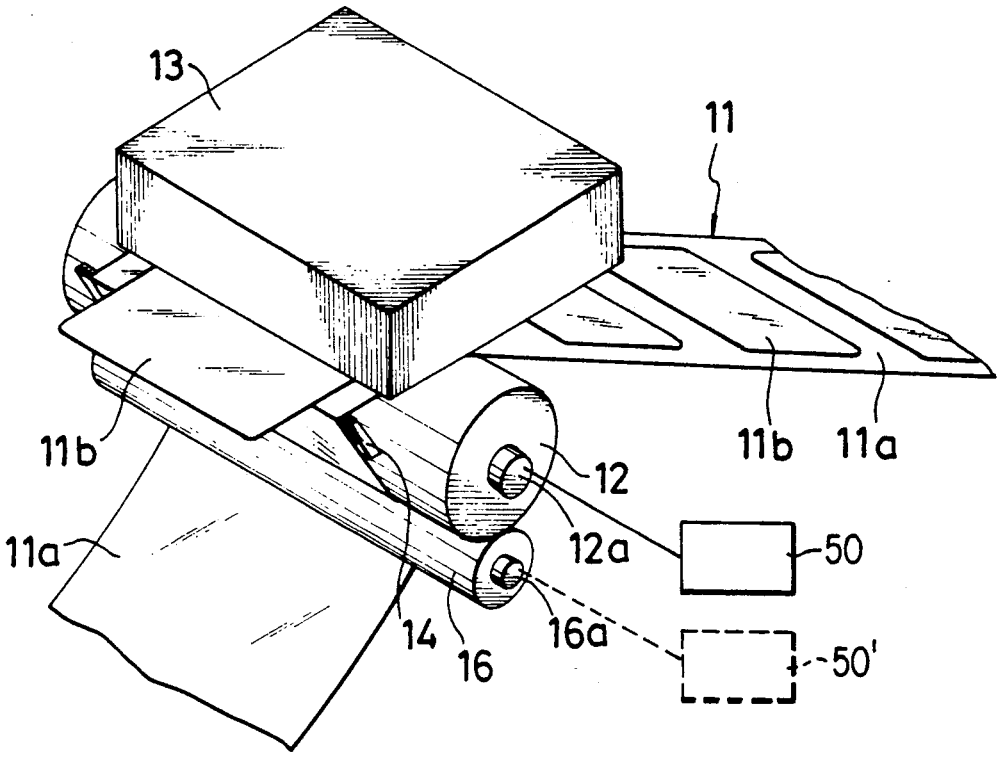
FIG. 3 is an entire perspective view of a label separating device in a first embodiment according to the present invention.
Figure 4:
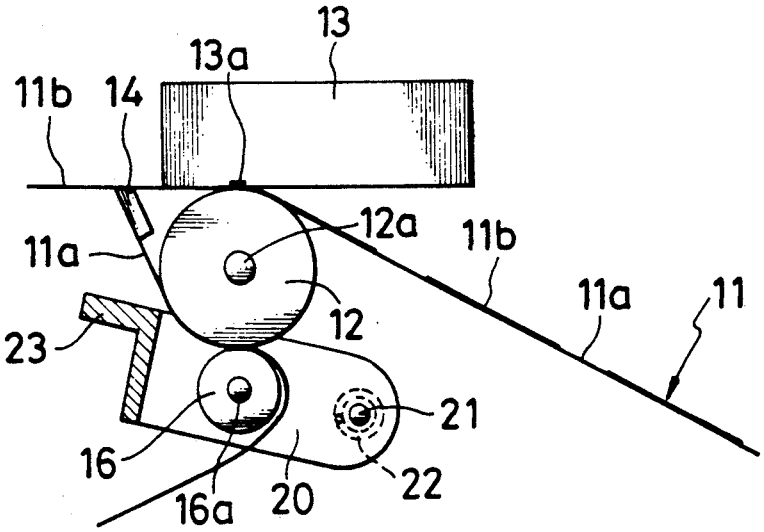
FIG. 4 is a side view of a label separating device in a first embodiment according to the present invention.

A first embodiment according to the present invention will now be described with reference to FIGS. 3 and 4. First, there is provided a pasteboard 11 comprising an elongated pasteboard 11*a* and a plurality of labels 11*b* which are stuck on the pasteboard 11*a* at predetermined intervals. The pasteboard 11 with labels is guided and held between a platen 12 and a thermal head 13 serving as a printing head. More specifically, the platen 12 is formed of a cylindrical member, and the whole thereof is mounted to a label printer body (not shown) in such a manner as to rotate about a platen shaft 12*a* as the central shaft thereof. A driving unit 50 (FIG. 3) for driving and rotating the platen 12 is connected to the platen shaft 12*a*. Alternatively, the driving unit may be connected to a pinch roller 16 rather than the platen 12 as illustrated by 50' (dash line in FIG. 3). Therefore, the platen 12 fulfills not only the function of the platen itself required for printing but also the function as a conveyance roller for conveying the pasteboard 11 with labels. The thermal head 13 is held in pressure contact with the platen 12 in a contacted state of a heat generating portion 13*a* thereof with the platen 12.

In the conveyance path of the pasteboard 11 with labels, a separating member 14 formed of a plate member is disposed near and downstream from the platen 12 and the thermal head 13.

Under the platen 12 is provided a pinch roller 16 so as to be movable into contact with and away from the platen. A roller shaft 16*a* of the pinch roller 16 is mounted to a frame 20, whereby the pinch roller 16 is held rotatably. The frame 20 is mounted to the label printer body rotatably about a support shaft 21 so that the roller shaft 16*a* of the pinch roller 16 is parallel to the platen shaft 12*a* of the platen 12. Around the support shaft 21 is wound a coiled torsion spring 22, one end of which is fixed to the label printer body while the other end of which is fixed to the frame 20. The frame 20 is urged by the torsion spring 22 so that the pinch roller 16 is kept in contact with the platen 12. Further, the frame 20 is provided with a handle 23 in a position below the separating member 14. The heat generating portion 13*a* of the thermal head 13, the platen shaft 12*a* of the platen 12 and the roller shaft 16*a* of the pinch roller 16 are substantially aligned on a vertical line.

In using the label separating device of the above construction, first the pasteboard 11*a* which has been guided between the platen 12 and the thermal head 13 and drawn out from the separating member 14 is inserted between the platen 12 and the pinch roller 16. In more particular terms, the frame 20 is turned downwards with the handle 23 to disengage the pinch roller 16 from the platen 12. In this state, the pasteboard 11*a* is inserted between the platen 12 and the pinch roller 16. Upon release of the handle 23, the frame 20 returns to its original position under the biasing force of the torsion spring 22, so that the pinch roller 16 comes into abutment with the platen 12. At this time, tension is applied to the pasteboard 11*a*.

Then, the platen 12 is rotated by the driving unit 50 connected thereto, whereby the pasteboard 11 with labels is conveyed, and predetermined matters are printed on the label 11*a* by the thermal head 13. At the same time, the pasteboard 11*a* inserted between the platen 12 and the pinch roller 16 is also conveyed, so that tension is applied to the pasteboard 11*a*. Therefore, when the pasteboard 11 with labels after printing arrives at the separating member 14, only the pasteboard 11*a* is bent at an acute angle along the separating member, while the printed label 11*b* is separated from the pasteboard 11*a* and is issued from an issuance port (not shown).

Thus, in this embodiment, both the conveyance of the pasteboard 11 with labels for printing each label 11*b* and the conveyance of the pasteboard 11*a* for separating the label 11*b* after printing are performed by the rotation of the platen 12. Thus, the parts required for the means to convey the pasteboard 11 with labels and those required for the means to separate the label 11*b* can be used in common. Consequently, the number of the whole parts of the label printer decreases, thus contributing to the reduction of parts cost; besides, the manufacture of the entire label printer becomes easier, thus leading to shortening of the assembling time and reduction of the manufacturing cost; and further, the smaller space occupied by the label separating device contributes to the reduction in size of the entire label printer. Additionally, since the peripheral speed of the platen 12 is constant at any part of the peripheral surface of the platen 12, the conveyance speed of the pasteboard 11 with labels passing the heat generating portion 13*a* of the thermal head 13 and the conveyance speed of the pasteboard 11*a* after separation of a printed label 11*b* become equal to each other, that is, no discrepancy will occur between these two speeds. Consequently, defective separation of the label 11*b* and defective printing for the label 11*b* can be surely prevented.

The separating member 14 is disposed near the thermal head 13 and the roller shaft 16*a* of the pinch roller 16 is disposed in a position substantially opposed to the heat generating portion 13*a* of the thermal head 13. In such a positional relation of the components, the pasteboard 11*a* is wound around about a quarter of the peripheral surface of the platen 12. Consequently, the frictional resistance between the platen 12 and the pasteboard 11*a* is increased to ensure the conveyance of the pasteboard 11*a* by the platen 12, and defective separation of the label 11*b* can be prevented. Besides, since the handle 23 of the frame 20 is positioned near the issuance port of the label 11*b*, the engaging and disengaging operation for the pinch roller 16 with respect to the platen 12 can be done more easily.

Although in this embodiment the driving unit 50 is connected to the platen 12, the platen 12 may be of a freely rotating structure as already explained a driving unit 50' (FIG. 3) may be connected to the pinch roller 16.

Figure 5:
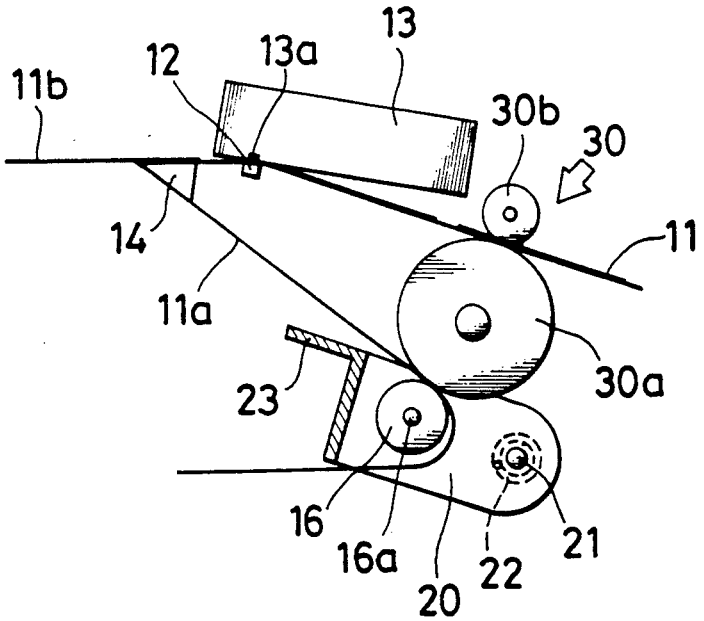
FIG. 5 is an entire side view of a label separating device in a second embodiment according to the present invention.

A second embodiment of the present invention will now be described with reference to FIG. 5. The same portions as in the first embodiment are indicated by the same reference numerals and will not be explained. In this embodiment there is used a flat platen 12, and upstream of the pasteboard conveying path with respect to a thermal head 13 which is in abutment against the platen 12, and in a position close to the thermal head 13, there is provided a pasteboard conveying portion 30 for the conveyance of a pasteboard 11 with labels. The pasteboard conveying portion is composed of a conveyance roller 30*a* which is connected to a driving unit (not shown) and is given a driving force thereby, and a printing pinch roller 30*b* which is in abutment against the conveyance roller 30*a* through the pasteboard 11 with labels. A pinch roller 16 is also in abutment against the conveyance roller 30*a*.

With this construction, as the conveyance roller 30*a* rotates, the pasteboard 11 with labels is conveyed toward the thermal head 13. Since the pinch roller 16 is in abutment against the conveyance roller 30*a*, tension is applied to the pasteboard 11 with labels and a pasteboard 11*a* in the range from the conveyance portion 30 through the thermal head 13 and a separating member 14 up to the abutment portion between the conveyance roller 30*a* and the pinch roller 16, whereby printing of each label 11*b* and separation thereof can be done exactly.

Further, since there is used a flat platen 12, the positional accuracy between a heat generating portion 13*a* and the platen 12 can be set relatively rough, thus facilitating the manufacture of the label printer.

Although in this embodiment a driving unit is connected to the conveyance roller 30*a*, a driving unit may be connected to the pinch roller 16 or the printing pinch roller 30*b*. Further, the surface of the platen 12 which is in abutment against the heat generating portion 13*a* may be a curved surface.

What is claimed is:

1. A label separating device in a label printer comprising:

a conveyance roller for conveying a pasteboard with labels which is guided along a predetermined path through a first nip portion between said conveyance roller and a printing head, a shaft, said conveyance roller being rotatable about said shaft;

a separating member disposed on a downstream side, with respect to the pasteboard conveyance path, of the conveyance roller and said printing head, said separating member holding the pasteboard with labels between the printing head and the conveyance roller in a position close to the printing head and bending a portion of said pasteboard at the separating member so as to separate a label from said pasteboard after printing;

a pinch roller for holding at a second nip portion between the pinch roller and the conveyance roller the pasteboard portion which has been bent and separated from said label by said separating member after printing; and means for mounting said pinch roller in a position in which the pasteboard is wound around said conveyance roller, such that the first nip portion, the second nip portion and the shaft are all aligned along a single vertical plane.

2. A label separating device in a label printer according to claim 1, wherein a driving unit for driving and rotating said conveyance roller is connected to said conveyance roller.

3. A label separating device in a label printer according to claim 1, wherein a driving unit for driving and rotating said pinch roller is connected to said pinch roller.

4. A label separating device in a label printer according to claim 1, wherein the printing head is a thermal head.

5. A label separating device in a label printer according to claim 1, wherein the conveyance roller contacts said thermal head to function as a platen.

6. A label separating device in a label printer according to claim 1, comprising:

a single driving unit connected to said conveyance roller for conveying said pasteboard between said thermal head and said conveyance roller, around said separating member, and between said conveyance roller and said pinch roller, wherein said driving unit conveys said pasteboard with labels for printing and separates said label from said pasteboard after printing.

7. A label separating device in a label printer according to claim 1, comprising:

a single driving unit connected to said pinch roller for conveying said pasteboard between said thermal head and said conveyance roller, around said separating member, and between said conveyance roller and said pinch roller, wherein said driving unit conveys said pasteboard with labels for printing and separates said label from said pasteboard after printing.

8. A label separating device in a label printer according to claim 1, comprising:

means for urging the pinch roller into pressure contact with said conveyance roller.

* * * * *